US007078991B1

(12) United States Patent
Seok et al.

(10) Patent No.: US 7,078,991 B1
(45) Date of Patent: Jul. 18, 2006

(54) SUPERCONDUCTING COIL

(75) Inventors: Bok-Yeol Seok, Suwon-si (KR); Chanjoo Lee, Suwon-si (KR)

(73) Assignee: Hyundai Heavy Industries Co., Ltd. (KR)

( * ) Notice: Subject to any disclaimer, the term of this patent is extended or adjusted under 35 U.S.C. 154(b) by 0 days.

(21) Appl. No.: 11/156,390

(22) Filed: Jun. 20, 2005

(51) Int. Cl.
*H01F 6/00* (2006.01)

(52) U.S. Cl. ..... 335/216; 336/DIG. 1

(58) Field of Classification Search ..... 335/216; 336/DIG. 1
See application file for complete search history.

(56) References Cited

U.S. PATENT DOCUMENTS 5,247,271 A * 9/1993 Kawamura et al. ..... 335/216
5,310,705 A * 5/1994 Mitlitsky et al. ..... 505/211
5,914,647 A * 6/1999 Aized et al. ..... 335/216

* cited by examiner

*Primary Examiner*—Ramon M. Barrera
(74) *Attorney, Agent, or Firm*—Cantor Colburn, LLP

(57) ABSTRACT

Provided is a superconducting coil capable of reducing a magnetic field perpendicularly irradiated to a wide surface of a superconducting wire composing a coil of a superconducting electric device by winding a low current density coil, driven with a current density lower than that flowing through a main coil, on a line extending from the main coil. The superconducting coil includes: a main coil driven with a current density flowing by entering current; and a low current density coil located on a line extending from upper and lower ends of the main coil, and series connected to a coil having the same shape as a portion of the main coil to be driven with a current density lower than that flowing through the main coil.

9 Claims, 4 Drawing Sheets

SUPERCONDUCTING COIL

BACKGROUND OF THE INVENTION

1. Field of the Invention

The present invention relates to a superconducting coil and, more particularly, to a superconducting coil capable of reducing a perpendicular magnetic field to the wide face of a superconducting wire by introducing a low current density coil into upper and lower ends of a main coil, in which the perpendicular magnetic field is most intense.

2. Description of the Related Art

As is well known, a superconductor industry, which is stood in the spotlight as a future technology, has been widely developed from superconducting materials to appliances, and therefore, advanced companies and countries have progressed in research and investment.

In particular, after a high temperature superconductor has been developed, its cooling method has been changed from a liquid helium cooling method to a liquid nitrogen cooling method. Therefore, it is anticipated that the high temperature superconductor will be very advantageous in economic and industrial viewpoint.

In the case of the high temperature superconducting electric devices using the high temperature superconductor, it is possible to make them have small size and weight and to optimize its efficiency in comparison with conventional electric devices.

In general, superconducting electric devices mostly have a main component having a coil shape, for example, a winding part of a transformer, a field coil of a rotator, an armature coil, and so on.

At this time, a superconducting coil used therein can conduct a high current in comparison with a copper coil, since there is no loss due to the zero resistance property of the superconducting coil and therefore it is possible to substantially increase current density.

As a result, the superconducting devices have weight and volume remarkably smaller than that of general electric devices.

However, as shown in a graph of FIG. 1 illustrating a correlation between a critical current density and a perpendicular magnetic field, a high temperature superconducting wire widely used nowadays is sensitive to a magnetic field essentially concomitant with a coil.

In particular, as shown in FIG. 1, the magnetic field perpendicular to the wire substantially decreases the critical current density, which is one of the characteristics of the wire, and increases alternating current loss.

Therefore, it was difficult to manufacture a high temperature superconducting coil capable of forming a high magnetic field. In order to solve the problem, a method of decreasing a cooling temperature of the superconductor is currently used.

That is, the critical current density is increased when the temperature of the superconductor is deceased as described above, and therefore, the critical current is also increased even when the same perpendicular magnetic field is applied.

Currently, a method of decreasing a cooling temperature of a high temperature superconductor to 25~30 K (Kelvin temperature) to increase a critical current is used in several companies manufacturing superconducting electric devices. However, the method has problems of decreasing cooling efficiency, increasing cooling cost and therefore increasing overall price of the device, together with decreasing reliability of the device.

SUMMARY OF THE INVENTION

In order to solve the foregoing and/or other problems, it is an aspect of the present invention to provide a superconducting coil capable of reducing a perpendicular component of a magnetic field applied to a coil of a superconducting electric device by winding a low current density coil, driven with a current density lower than that flowing through a main coil, on a line extending from the main coil.

The foregoing and/or other aspects of the present invention may be achieved by providing a superconducting coil for reducing a perpendicular magnetic field including: a main coil driven with a current density flowing by entering current; and a low current density coil located on a line extending from upper and lower ends of the main coil, and parallelly connected to a coil having the same shape as a portion of the main coil to be driven with a current density lower than that flowing through the main coil.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE INVENTION

Figure 1:
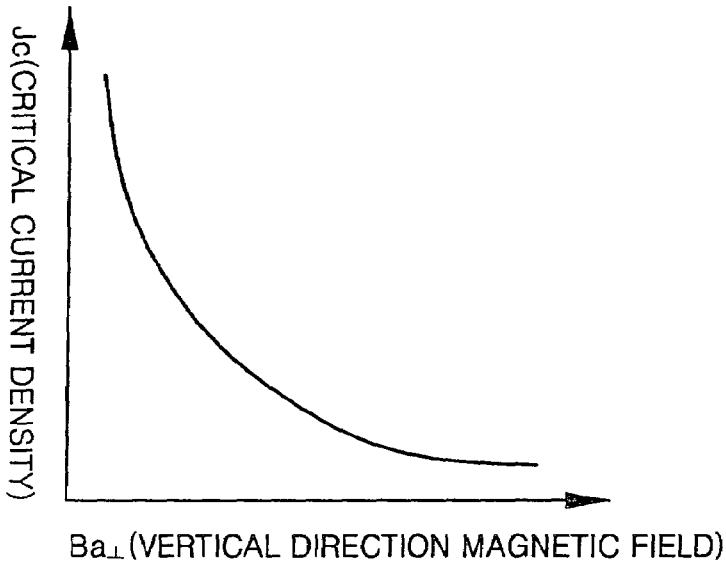
FIG. 1 is a graph representing a correlation between a critical current density and a perpendicular magnetic field of a conventional superconducting wire.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
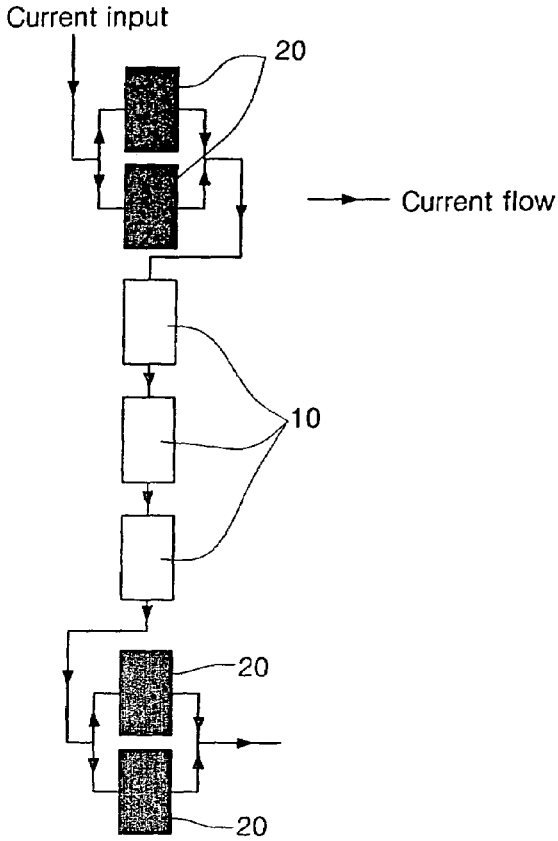
FIG. 2 is a view illustrating an embodiment of a superconducting coil for reducing a perpendicular magnetic field in accordance with the present invention.

FIG. 2 is a view illustrating an embodiment of a superconducting coil for reducing a perpendicular magnetic field in accordance with the present invention.

Referring to FIG. 2, the superconducting coil for reducing a perpendicular magnetic field includes a main coil 10 (MC, white blocks in FIG. 2), and a low current density coil 20 (LCC, black blocks in FIG. 2).

The main coil 10 is driven with a current density flowing by entering current, as shown in FIG. 2.

The low current density coil 20 is located on a line extending from upper and lower ends of the main coil 10, as shown in FIG. 2, and driven with a current density lower than that flowing through the main coil 10.

That is, while the current flowing through the low current density coil 20 is equal to the current flowing through the main coil 10, the low current density coil has a current density lower than that of the main coil 10 since the low current density coil 20 has an area larger than that of the main coil 10.

Generally, the magnetic field is increased in proportion to the flowing current density. That is, the more the current density becomes larger, the more the magnetic field increases.

Therefore, the low current density coil 20 has a current density region smaller than that of the main coil 10 to make the magnetic field around the low current density coil 10 smaller.

In particular, since upper and lower ends of the superconducting coil have the largest perpendicular magnetic field, it is possible to substantially reduce the perpendicular magnetic field when the low current density coil 20 is introduced into the ends.

As shown in FIG. 2, a parallel coil is wound to increase a cross-sectional area of the low current density coil 20, thereby implementing the low current density coil 20.

The low current density coil 20 is additionally wound on a line extending from the main coil 10 in series.

As a result, the entire height of the superconducting coil becomes slightly higher to increase an area of the low current density coil 20.

Therefore, the superconducting coil for reducing a perpendicular magnetic field is capable of reducing a perpendicular component of a magnetic field applied to a superconducting electric device by installing the low current density coil 20 at the upper and lower ends of the superconducting coil.

That is, when the low current density coil in accordance with an embodiment of the present invention is adapted to design a high temperature superconducting transformer, the following effects will be obtained.

In this design, the high temperature superconducting transformer has a rated operating voltage of 3-phase 60 MVA (154 kV/23 kV), a low voltage superconducting winding totally has 204 turns as a two-layered solenoid, and a high voltage superconducting winding totally has 1364 turns composed of 44 double pancakes.

Figure 3:
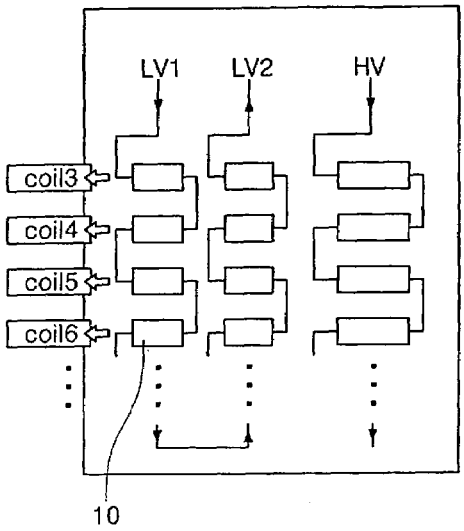
FIG. 3 is a conceptual view of a superconducting coil for reducing a perpendicular magnetic field without a low current density coil.
Figure 4:
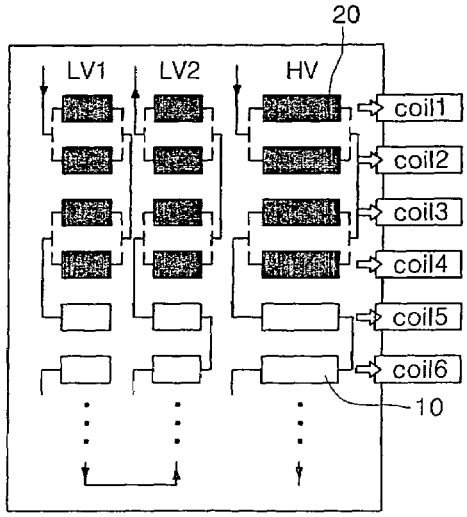
FIG. 4 is a conceptual view of a superconducting coil for reducing a perpendicular magnetic field, on which a low current density coil is wound in accordance with the present invention.

Referring together a basic model composed of only the main coil 10 as shown in FIG. 3 and a series-connected model of the main coil 10 and the low current density coil 20 as shown in FIG. 4, LV1 of FIGS. 3 and 4 is a low voltage winding adjacent to a core, and LV2 of FIGS. 3 and 4 is a low voltage winding adjacent to a high voltage winding.

In addition, as shown in FIG. 4, the low current density coil 20 (LCC, black blocks in FIG. 4) has a half of a flowing current density in comparison with the main coil 10 (MC, white blocks in FIG. 4).

Figure 5:
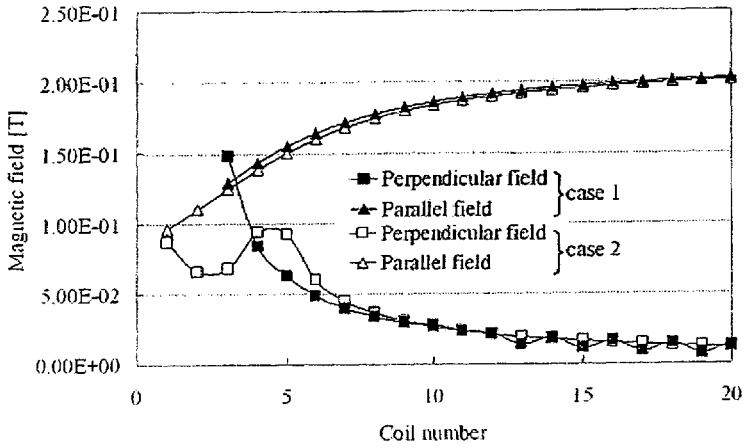
FIG. 5 is a graph representing distribution of a magnetic flux density of a LV1 coil of an embodiment of the present invention.

That is, referring to an analysis result of a maximum perpendicular flux loss with respect to the low voltage winding LV1 in the graph of FIG. 5, while the maximum perpendicular magnetic flux loss is generated by about 0.15 T when the low current density coil 20 is not wound as shown in FIG. 3, the maximum perpendicular magnetic flux loss is generated by about 0.1 T or less when the low current density coil 20 is wound.

Therefore, the critical current of the winding is increased about 1.2 times, as a result, it is possible to reduce the overlapping number of the wire to substantially reduce the amount of the wire used in the superconducting winding.

Figure 6:
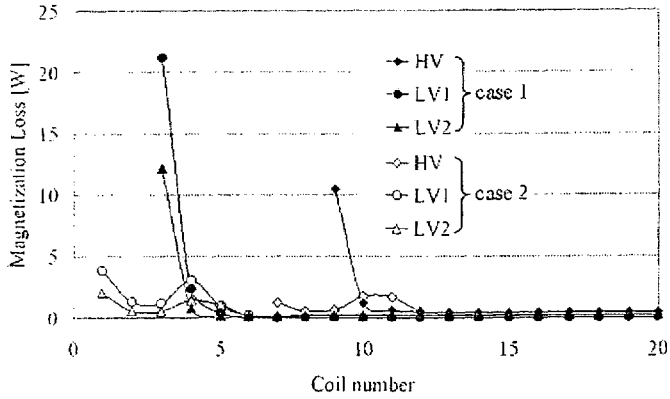
FIG. 6 is a graph representing magnetization loss in a main coil and a low current density coil of an embodiment of the present invention.

In addition, referring distribution of magnetization loss at each winding depending on decrease of magnetic flux loss in the graph of FIG. 6, while the magnetization loss is totally generated by 210 W/phase when the low current density coil 20 is not wound as shown in FIG. 3, and the magnetization loss is decreased by about 62% in comparison with the magnetization loss of FIG. 3 when the low current density coil 20 is wound as shown in FIG. 4. Particularly, it is appreciated that the magnetization loss is remarkably decreased at an end winding having a relatively large perpendicular magnetic flux loss.

As can be seen from the foregoing, the superconducting coil for reducing a perpendicular magnetic field in accordance with the present invention has effects as follows.

First, it is possible to solve the problems of increasing the amount of a superconducting wire and volume of the coil by lowering the perpendicular magnetic field generated at the superconducting coil by virtue of addition of the low current density coil, and Second, it is possible to increase cooling efficiency of the entire superconducting coil to make a cooling system compact by introducing the low current density coil to lower the current density and the perpendicular component of the magnetic field and to thereby reduce alternating current loss.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A superconducting coil for reducing a perpendicular magnetic field, comprising:

a main coil driven with a current density flowing by entering current; and a low current density coil driven with a current density lower than that flowing through the main coil, wherein both a solenoid winding and a pancake winding are employed.

2. The superconducting coil according to claim 1, wherein the low current density coil is located on a line extending from upper and lower ends of the main coil.

3. The superconducting coil according to claim 2, wherein the low current density coil is wound on the line extending from upper and lower ends of the main coil in series.

4. The superconducting coil according to claim 2, wherein the low current density coil is wound in a parallel manner and has a cross-sectional area larger than that of the main coil.

5. A high-temperature superconducting transformer comprising:

a core;

a first low voltage superconducting winding adjacent to the core;

a second low voltage superconducting winding such that turns of the first and second low voltage superconducting windings define a two-layered solenoid; and a high voltage superconducting winding adjacent to the second superconducting winding and having turns composed of double pancakes, wherein each of the first and second low voltage superconducting windings and the high voltage superconducting winding includes a low current density coil having a half of a flow current density in comparison with a remaining main coil.

6. The high-temperature superconducting transformer of claim 5, wherein the low current density coil is disposed at terminal ends of the core.

7. The high-temperature superconducting transformer of claim 6, wherein each low density coil is wound in a parallel manner to increase a cross-sectional area of the low density coil.

8. The high-temperature superconducting transformer of claim 7, wherein each low density coil has a same cross sectional area of a line extending from the main coil.

9. The high-temperature superconducting transformer of claim 5, wherein the low voltage superconducting winding has a total of 204 turns defining the two-layered solenoid and the high voltage superconducting winding has a total of 1364 turns of 44 double pancakes.

* * * * *